US005492037A

United States Patent [19]

Graham

[11] Patent Number: 5,492,037

[45] Date of Patent: Feb. 20, 1996

[54] SKATE SHARPENING MECHANISM

[76] Inventor: Gilbert B. Graham, 1222 Shoreline Dr., Santa Barbara, Calif. 93109

[21] Appl. No.: 423,229

[22] Filed: Apr. 17, 1995

[51] Int. Cl.[6] ..... B21K 17/00

[52] U.S. Cl. ..... 76/83; 76/82

[58] Field of Search ..... 76/83, 82; 451/557, 451/558

[56] References Cited

U.S. PATENT DOCUMENTS

| | | | |
|---|---|---|---|
| 2,978,930 | 4/1961 | Bratton | 76/83 |
| 3,164,932 | 1/1965 | Morith | 76/83 |
| 3,957,880 | 8/1971 | Norgiel | 76/83 X |
| 4,241,544 | 12/1980 | Hampton | 76/83 X |

FOREIGN PATENT DOCUMENTS

| | | | |
|---|---|---|---|
| WO89/00443 | 1/1989 | WIPO | 76/83 |

*Primary Examiner*—Douglas D. Watts

[57] ABSTRACT

A mechanism for the sharpening of skate blades comprising a small cylindrical honing stone or similar device, supported and located by two rollers which are caused to rotate, thus rotating the stone as this slides back and forth along the concavity of the blade. This results in sharpening the edges and forming a concavity of a suitable radius. A means of tilting the stone to maintain this tangent to the curvature of the blade, is also achieved such that the total cylindrical surface of the cutting (honing) stone is utilized.

4 Claims, 2 Drawing Sheets

SKATE SHARPENING MECHANISM

BACKGROUND

1. Field of Invention

This invention relates to ice skating blades, specifically to an improved method of sharpening.

2. Description of Prior Art

Skate blades used for ice hockey, figure, free style and dance, etc., are made from hardened and tempered steel having sharp inside and outside edges separated by a concavity. With use, these edges become dull and the concavity which supports the skater's weight, loses its smoothness and shape thus degrading the performance of the skater.

Heretofore it was common practice to restore these edges and the concavity using a grinding machine designed for this purpose. Such machines generally utilize a flat disc-shaped grinding wheel mounted on a vertical shaft, rotating at high speed. This in turn is mounted to a flat steel table such that the grinding wheel is several inches above the surface of the table. To grind the concavity, a suitable radius for each type of skate must be formed on the rim of the grinding wheel using a radius forming tool. The skating blade with boot attached is clamped on its side to a steel block which slides easily in any direction over the table surface. The center line of the skate blade runs parallel with the surface of the table and the grinding wheel is adjusted to a suitable level to match the center line of the blade.

Using a continuous sweeping motion, the operator then moves the skate blade against the grinding wheel, thus restoring the concavity and sharpening both edges. Some machines have two stations so that a medium grit and a fine grit grinding wheel are available. Other machines use similar grinding methods.

New skate blades are manufactured with very specific curvatures to enable a skater to perform intricate maneuvers on the ice. Undulations and change of curvature of the skate blade will occur with each resharpening. Operator skill and experience is critical in attempting to minimize these distortions.

On some machines a template may be used to restore the curvature. However, this method is seldom used since a template for each size and type of skate blade is required. Also a considerable amount of metal removal is often necessary to restore the original curvature.

To grind the concavity a suitable radius for each type of skate must be formed on the edge of the grinding wheel using a special diamond tool.

During the sharpening operation the grinding wheel, rotating at high speed, heats the skate blade. This in turn permanently softens the edges being sharpened resulting in the need for more frequent regrinds since softened edges become blunt more rapidly than hardened edges with use. Such heating could be avoided using a cutting fluid, however skate grinding machines are designed to operate "dry".

Some disadvantages of the above method of sharpening skate blades are listed below:

OPERATOR SKILL REQUIRED. The operator must have a high degree of skill in attempting to maintain an even pressure and steady traverse without bounce while pressing the skate blade against the spinning grinding wheel.

DISTORTION. Regardless of operator skill, undulations and curvature distortions do occur, this being cumulative with future regrinding.

HIGH COST. Different blades require different concavity radii. An expensive diamond tool is used to form whichever radius is needed on the edge of the grinding wheel. During use, further dressing of the grinding wheel becomes necessary due to loading and glazing thus reducing the grinding wheel diameter to the point where frequent replacements become necessary.

SOFTENS EDGES. Grinding without using cutting fluid causes severe heating, particularly at the edges of the blade. This results in softening of these hardened steel edges which now blunt rapidly with use, leading to more frequent resharpenings.

ROUGH SURFACE FINISH. A polished surface on the concavity of the blade is desirable for low skating friction (the total weight of the skater is concentrated on a very small area of this surface). However when using a fine grit or polishing wheel without the use of cutting fluid, severe softening of the edges will occur. Hence a relatively coarse finish instead of a mirror finish must be tolerated.

DIFFICULTY IN CHANGING GRINDING WHEEL RADIUS. The correct concavity radius must be formed on the grinding wheel using a radius fixture with a diamond tool. This procedure is time consuming requiring expertise. The fixture containing the diamond tool must be adjusted to the required radius prior to shaping the grinding wheel. It is not practical to have a set of grinding wheels each with a different peripheral radius since the wheel, when mounted, will not run precisely true, hence the need to be recontoured after mounting.

LACK OF PORTABILITY. Most machines are too heavy and cumbersome to transport easily (e.g. in the trunk of a car).

DEGRADATION OF SKATING ABILITY. Skaters usually delay sharpening until a regrind is absolutely necessary since a potential setback in skating performance is anticipated due to the change in curvature as a result of sharpening.

SKATING BLADE REPLACEMENT. By design the skate blade has a specific curvature. Towards the front the curvature becomes tighter (the rocker). This transition is used by the skater to execute 3-turns, counters, etc., and when flattened due to regrinding, the skater must compromise her ability with an increased danger of accident. Also excessive loss of metal often occurs at the heel end of the skate blade posing a danger to the skater of falling backwards. A common solution is the purchase of new blades.

PROTECTIVE EQUIPMENT REQUIRED. When grinding skate blades, the operator must wear both goggles and breathing mask to protect him from high velocity metal particles and the inhalation of metal dust.

OBJECTS AND ADVANTAGES

Most enthusiastic skaters would find it desirable to own a skate sharpening machine having none of the above disadvantages. Accordingly these problems are eliminated with my invention whose objects and advantages are:

SKILL NOT REQUIRED. The method and mechanism described below forms the basis for a machine which can be used by an unskilled operator. Once the skates are clamped on to the machine, the stone inserted, and the machine started, the sharpening process is entirely automatic. Heretofore the operator required training and expertise in sliding the fixture horizontally to touch the skate blade against the rotating grinding wheel, at the same time traversing the blade along its length while attempting to avoid undulations and uneven metal removal.

RETENTION OF CURVATURE. Using this invention the removal of metal will be relatively constant over the length of the blade thus distortion of the curvature will be minimized. Heretofore distortion of the blade was inevitable and cumulative since no mechanical means of control was used.

LOWER COST. Honing stones suitable for use with this invention are less expensive than grinding wheels.

AVAILABILITY. Cylindrical honing stones have been used by tool and die makers for decades and consequently are readily available in a range of grit sizes and diameters.

LOW SKATING FRICTION. After sharpening the skate blades the concavity can be polished by inserting a fine grit or polishing stone (e.g. Arkansas stone). This enables the skater to glide over the ice with less effort, improving performance. Heretofore this fine polishing was difficult, if not impossible to achieve.

RETENTION OF SHARPNESS. Using my invention, there is no softening of the skate blade edges since this is a cold wet process. In contrast, the dry grinding process causes severe heating and softening of the factory hardened edges which blunt more rapidly with use.

EASE OF CHANGING CONCAVITY RADIUS. By inserting a different diameter stone the concavity radius is readily altered within a wide range of radii. Also the polishing stone might be slightly larger or smaller in diameter than the relatively coarse honing stone previously used for sharpening, yet alignment will be maintained and no adjustment to the machine will be necessary. Heretofore the concavity radius had to be formed on the grinding wheel using a radius fixture with a diamond tool. This procedure is time consuming and requires expertise since the fixture containing the diamond tool must be adjusted to the required radius and the grinding wheel is diminished on each reshaping.

VERSATILITY. Different stones such as coarse, medium and fine India stones can be used with my invention. Also diamond coated cylinders or the lapping process using a brass cylinder and rouge or any similar abrasive system are all compatible with this invention.

PORTABILITY. The machine is a portable unit not unlike a home sewing machine, which can readily be placed in the trunk of a car. Most existing skate sharpeners are heavy and cumbersome.

SKATING PROFICIENCY. Maintaining curvature and sharpness of the skate blade aids the skater's performance. With this invention touch-ups are fast and easy, thus enhancing the skater's opportunity for improvement. Skaters usually delay sharpening until a regrind by a skilled expert is absolutely necessary since the trauma of readjustment to a resharpened blade often results in a setback in skating prowess. This invention is ideally suited for use by any skater intent on keeping her skates in perfect condition.

STONE LOADING & GLAZING PROBLEMS ALLEVIATED. Loading or clogging of the honing stone with metal cuttings is minimized since the honing stone reverses after each stroke along the length of the blade concavity. Also a fresh cutting surface is continually presented as the stone rotates. In addition the honing fluid lubricates the cutting action and the heating problems do not occur. Glazing of the stone is also minimized since no heating takes place.

STONE SHAPE RETENTION. The use of this mechanism ensures that stone wear is relatively even, thus roundness is maintained. Also the total cylindrical surface of the stone is used in a relatively regular pattern as this tilts to follow the curvature of the blade using the entire stone length.

SAFETY & CLEANLINESS. Protective equipment is unnecessary since this is a clean and easy method of sharpening skates. Any metal particles are captured by the small amount of honing fluid used and my invention is quiet and clean.

Further objects and advantages of my invention will become apparent from a consideration of the ensuing description and the accompanying drawings.

DRAWING REFERENCE NUMERALS

Figure 1:
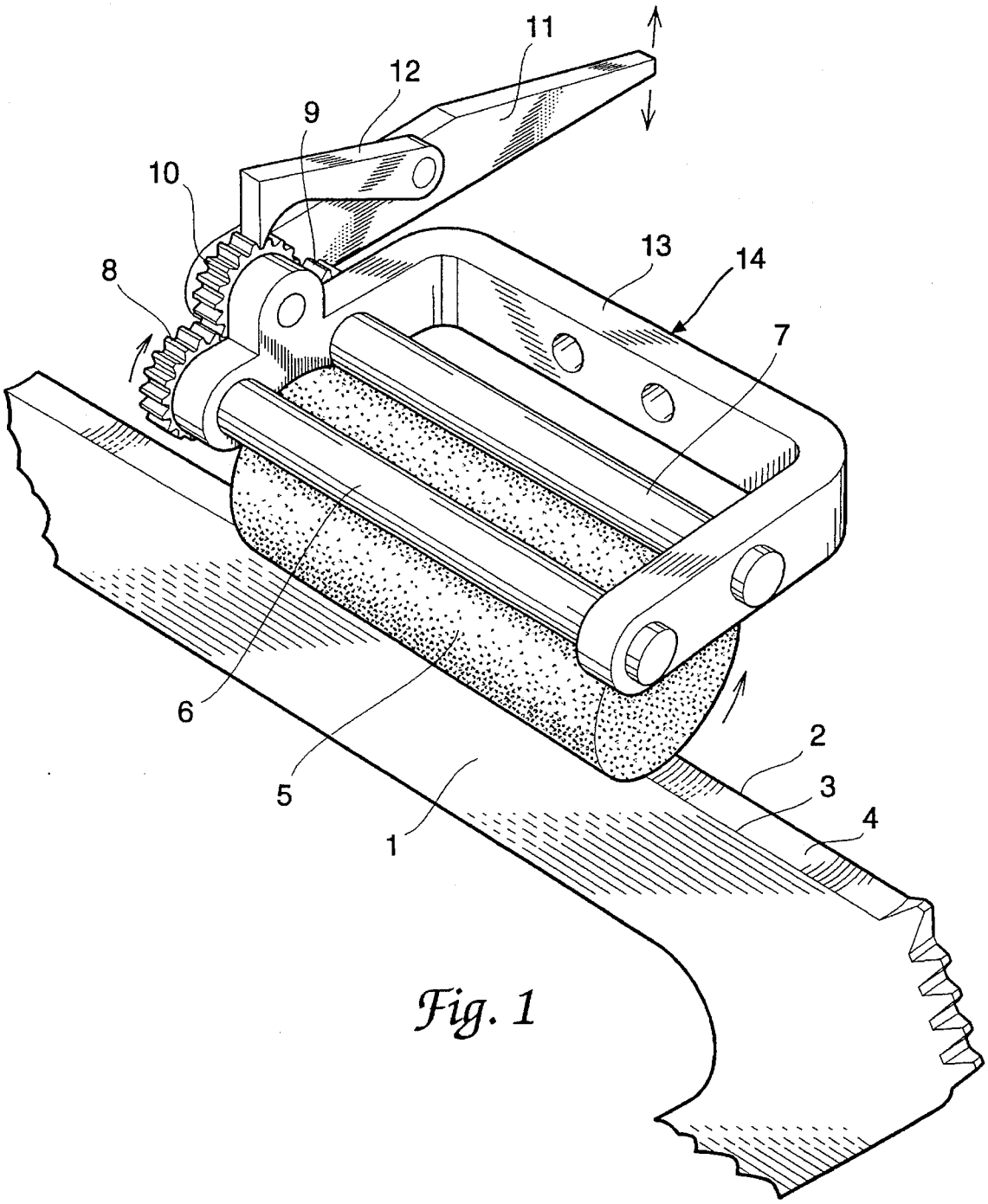
FIG. 1 shows a perspective view demonstrating the unique mechanism designed to locate, rotate and contain the honing stone.

1. skate blade
2. inside edge
3. outside edge
4. concavity
5. honing stone
6. outside roller
7. inside roller
8. inside gear
9. outside gear
10. center gear
11. lever
12. pawl
13. U-frame
14. U-frame assembly
15. shaft
16. carriage
17. guide rails
18. arm
19. spring

DESCRIPTION OF INVENTION

FIG. 1 shows a skating blade 1, having an inside and an outside edge 2 and 3, with a concavity 4 between. The cylindrical honing stone 5 is aligned centrally between the edges 2 and 3, and rests on the concavity surface 4. Rollers 6 and 7, are positioned to locate and align the stone 5, central to the inner and outer edges 2 and 3 of the blade 1.

A U-shaped frame 13 supports the rollers 6 and 7, such that the gap formed by the legs of the U-frame 13 is slightly larger than the length of the stone, while the longer rollers 6 and 7, are supported by free fitting holes or bearings. This U-frame 13 is rigidly fixed to an arm 18, such that adjustment of the angle between the arm 18 and U-frame 13 is possible.

Rollers 6 and 7, have similar gear wheels 8 and 9 fixed to one end and these gears 8 and 9, are meshed into a central gear 10, with a ratcheting or turning attachment 11 and 12.

Figure 2A:
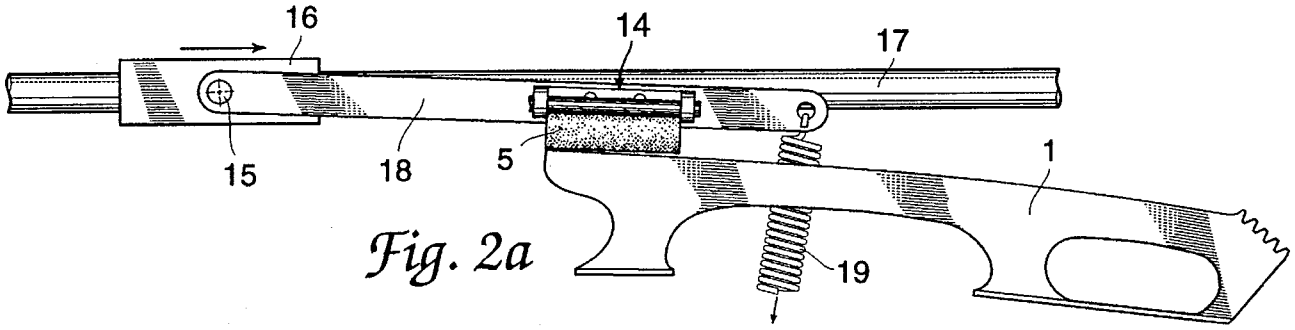
FIG. 2 shows three views (*a, b & c*) illustrating a mechanism to effect tangential contact as the honing stone moves forwards and backwards along the blade concavity while utilizing the entire length of the stone.
Figure 2B:
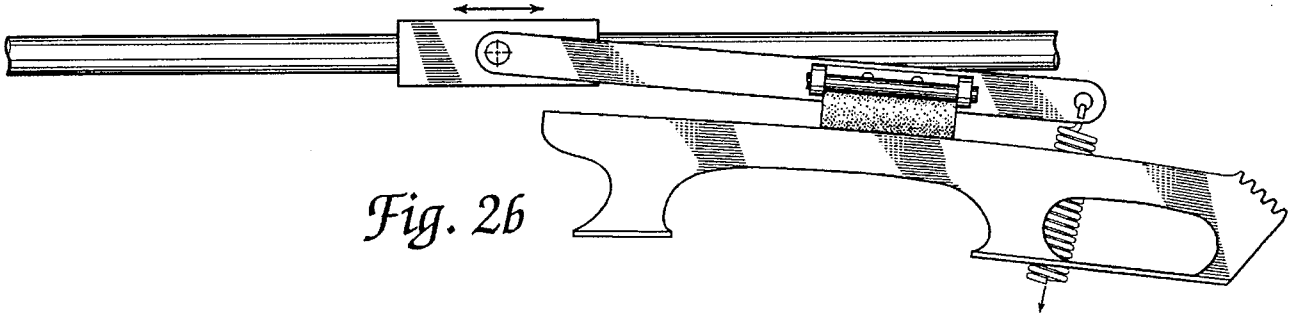
Figure 2C:
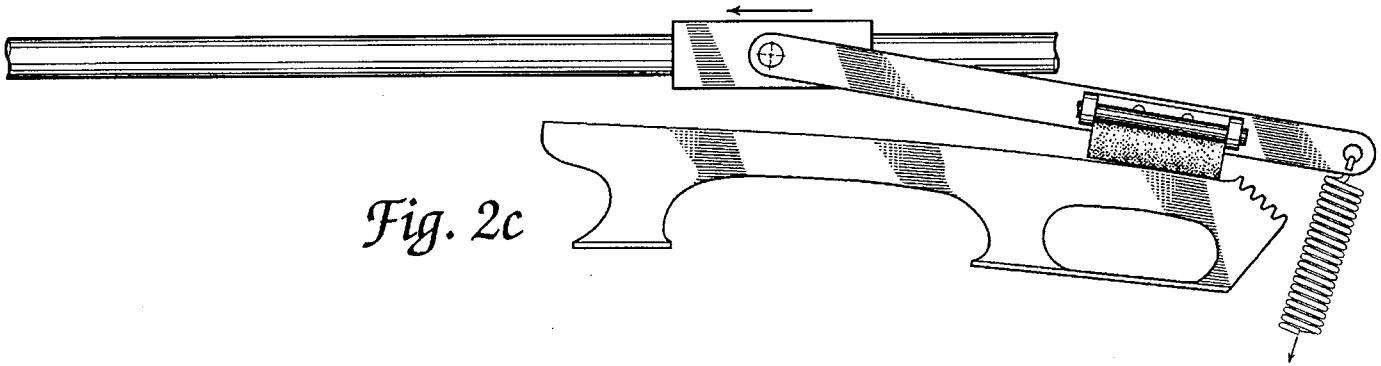

FIG. 2 shows the arm 18, pivoted on a shaft 15, fixed to the sliding carriage 16 of the skate sharpening machine. This arm 18, supports the U-frame assembly 14. Torque is applied to this arm 18 by a coil spring 19.

OPERATION OF INVENTION

The following disclosure describes a mechanism using a cylindrical honing stone 5, or similar abrasive device to hone the skate blade 1, thus correcting the concavity radius 4, and sharpening both edges 2 and 3. A stone diameter relating to blade width, style of skating and the skater's preference, is selected (i.e. hockey blades require a smaller radius concavity than free style blades). To maintain roundness and reduce loading of the stone 5, the mechanism herein described provides for rotation of this stone 5, by using two rollers 6 and 7. FIG. 1, whose longitudinal axes are parallel with that of the stone 5. These support and align the stone 5, relative to the center line of the skate blade concavity 4, being honed. By causing the rollers 6 and 7, to rotate incrementally while the stone 5, is sliding along the concavity, the rotation of the stone 5, is assured, since the friction between the stone and the surface being honed is low relative to the rolling friction between the honing stone 5, and the rollers 6 and 7.

This method of supporting and locating the stone 5, permits similar size stones having a wide range of grit sizes to be easily inserted for any desired result. A wide range of stone diameters may be used while maintaining the alignment between the center line of the stone 5, and blade 1.

Also the cylindrical honing device will not wear in discrete segments since the rotation is indexed in a non-repetitive manner.

It is advantageous to utilize the total cylindrical surface of the honing stone 5. This disclosure includes a method whereby this is achieved. To understand the mechanism involved, a description of one of several configurations follows:

The skate blade 1, with or without the boot attached, is clamped upside down to a fixed frame. The U-frame assembly 14 is mounted at the end of an arm 18 which pivots on a shaft 15. This shaft 15 is rigidly attached to a carriage 16 which moves back and forth horizontally on guide rails. These rails run parallel with the center line of the skate blade 1. The shaft 15 is arranged to project horizontally and at right angles to the guide rails 17. As the honing stone 5 moves forward, the arm 18 will fall, thereby tilting the stone 5 to maintain a tangential contact between the stone 5 and the curvature of the blade 1. The total change in angle (or tilt) which takes place during a complete stroke, can be decreased or increased by raising or lowering the forward end of the blade 1 relative to its heel end. With this adjustment, the entire length of the honing stone 5 may be used during a complete stroke or traverse. Another unique feature is that the abrasive device hones a longer path than the carriage movement (see FIG. 2). This is advantageous in designing a compact skate sharpening machine. As a result of this tilting motion combined with the rotation of the stone 5, the total cylindrical abrasive surface of the stone is used.

In the above text the honing stone 5 is described as moving back and forth while in operation. However, this disclosure covers all configurations using similar geometry, for example, traversing can be other than horizontal. Also the skate blade may be clamped to the moving carriage while the arm and honing stone assembly 14, can be mounted to the frame, thus achieving a similar result.

Since the honing stone assembly 14 has an up/down motion during each stroke (FIG. 2) this movement can be utilized to rotate the rollers 6 and 7. Electrical or other means may also be used. The method indicated here employs a ratchet (FIG. 1) with the pawl 12 mounted on a lever 11 This lever 11 is positioned to strike a finger mounted on the carriage 16, while the up/down motion is taking place. The rollers 6 and 7 are mechanically coupled using three gear wheel 8, 9 and 10, meshed together and rotated by the engagement of the pawl 12 as the lever drops.

It is desirable to maintain a steady load at the area of contact between the cylindrical honing stone 5 and the concavity 4 of the skate blade so that the rate of metal removal is roughly constant over the length of the blade 1, during honing. One method uses a spring 19 with one end attached to the arm 18 and the other end fixed to the frame, thus as the carriage 16 moves forward, the spring 19 will stretch, increasing the torque exerted on the arm 18. This action may be used to advantage since the contact area between the honing stone 5 and the concavity 4 also moves forward at the same time, thus requiring an increase in torque to maintain a steady load. By suitable spring design and orientation, a close compromise is achieved to maintain a relatively uniform load at this point of contact.

CONCLUSION & SCOPE OF INVENTION

Thus it will be seen that this skate sharpening mechanism provides a unique, reliable, precise, and clean method of sharpening skating blades with minimum distortion. A machine incorporating this mechanism can be used by skaters of almost any age as a convenient means of maintaining sharp edges and precise blade curvature, thus leading to more rapid improvement of skating ability.

While the above description contains many specifics, these should not be construed as limitations on the scope of the invention but rather as an example of one embodiment. Other variations are possible. Accordingly, the scope of the invention should be determined not by the embodiments illustrated but by the appended claims and their legal equivalents.

I claim:

1. A tool for sharpening skates comprising:

(a) an elongated guide rail for a guide block, (b) a guide block slidably mounted on said guide rail, (c) an arm pivotally mounted to said guide block for pivotal movement in a plane parallel to said guide rail wherein said arm supports, (d) a frame, (e) said frame rotationly mounting two rollers approximately parallel with said arm whereby a cylindrical honing stone may be placed between said rollers and the skate blade to be sharpened.

2. A tool for sharpening a skate according to claim 1, wherein gear means is provided for turning the rollers to thereby turn said honing stone.

3. A tool for sharpening skates according to claim 2, wherein said gear means includes a lever and pawl for turning gears that are mounted to the rollers.

4. A tool for sharpening skates according to claim 1, wherein a force applying device is coupled to said arm to bias it rotationly about it's pivot point.

* * * * *